US005850809A

United States Patent [19]

Watts

[11] Patent Number: 5,850,809

[45] Date of Patent: Dec. 22, 1998

[54] STEAM-RAISING SYSTEM

[75] Inventor: Robert John Watts, East Sussex, England

[73] Assignee: Eaton-Williams Group Limited, Kent, England

[21] Appl. No.: 601,440

[22] Filed: Feb. 14, 1996

[30] Foreign Application Priority Data

Feb. 16, 1995 [GB] United Kingdom ..... 9503076

[51] Int. Cl.[6] ..... F22D 7/00; F22D 5/26

[52] U.S. Cl. ..... 122/406.4; 122/451.1; 137/601

[58] Field of Search ..... 122/406.1, 406.4, 122/406.5, 448.1, 448.4, 451 R, 451.1, 451.2, 235.11, 235.29; 60/39.03, 39.181; 137/2, 599, 601

[56] References Cited

U.S. PATENT DOCUMENTS

| | | | |
|---|---|---|---|
| 3,135,282 | 6/1964 | Gray | 137/599 |
| 3,357,359 | 12/1967 | Schaub | 137/110 |
| 3,612,005 | 10/1971 | Lytle | 122/406.4 |
| 3,759,141 | 9/1973 | Zibrun | 91/20 |
| 3,879,616 | 4/1975 | Baker et al. | 60/39.182 |
| 4,019,467 | 4/1977 | Binstock | 122/406.5 |
| 4,036,011 | 7/1977 | Gupta | 60/39.18 |
| 4,325,410 | 4/1982 | Bernhardt et al. | 137/596.13 |
| 4,644,967 | 2/1987 | Wyatt et al. | 137/599 |
| 4,759,314 | 7/1988 | Banweg et al. | 122/406.4 |

*Primary Examiner*—William Doerrler
*Attorney, Agent, or Firm*—Dickinson Wright PLLC

[57] ABSTRACT

A steam-raising system comprising a boiler. The boiler has (a) a passageway for water and/or steam, (b) an inlet to the passageway through which water is introduced continuously for given periods when the boiler is in use, (c) a heater to heat the passageway, and (d) an outlet from the passageway from which steam emerges continuously as water is introduced through the inlet. The system further comprises a pump connected by a flow-path to the said inlet to pump water thereto along the said flow-path, and flow-control means in the said flow-path. The flow-control means comprise a plurality of lines which constitute a part of the flow-path, which are connected between the pump and boiler in parallel with one another, and which are independently openable to enable the amount of water delivered to the boiler to be varied.

12 Claims, 2 Drawing Sheets

STEAM-RAISING SYSTEM

The present invention relates to a steam-raising system comprising a boiler, especially but not exclusively one having (a) a passageway for water and/or steam, (b) an inlet to the passageway through which water is introduced continuously for given periods when the boiler is in use, (c) a burner to heat the passageway from the outside thereof, and (d) an outlet from the passageway from which steam emerges continuously as water is introduced through the inlet, the system further comprising a pump connected by a flow-path to the said inlet to pump water thereto along the said flow-path, and flow-control means in the said flow-path.

Hitherto, such flow-control means have comprised a distributor block from which extends a return line to a boiler feed tank which is located upstream of the pump. According to the amount of water returned to the feed-tank via the distributor block and the return line, a variable amount of water can be fed to the boiler in this prior construction. This enables a given output of superheated steam to be provided by the boiler at a given temperature, where that output is to be at a constant pressure or constant flow rate, or indeed according to any other criterion.

A disadvantage of such a construction is the energy used simply to return water to the feed tank.

The present invention seeks to provide a remedy.

Accordingly the present invention is directed to a steam-raising system having the construction set out in the opening paragraph of the present specification, in which the flow-control means comprise a plurality of lines which constitute a part of the flow-path, which are connected between the pump and boiler in parallel with one another, and which are independently openable to enable the amount of water delivered to the boiler to be varied.

Preferably, each of the said lines comprise a shut-off valve and a flow regulator. The shut-off valve may be a solenoid-operated valve either of a normally-open or a normally-closed construction.

The flow regulator may comprise one which maintains a constant flow through it substantially independently of the pressures upstream of its inlet and downstream of its outlet.

For example, the flow regulator may comprise a piston valve the inlet port of which has a variable opening which is dependent upon the relative position of the piston in the valve. The flow through the regulator may be through a fixed orifice across which a fixed pressure differential is maintained by means of the piston-valve. This may be achieved by means of resilient means acting on the piston, the force of which determines the pressure differential across the orifice.

A first one of the lines and also the construction of the boiler may be such that the flow rate allowed through that one of the lines when it is in the open condition, with the other lines in the closed condition, produces superheated steam at a given temperature in excess of the normal boiling temperature of water at the steam output pressure of the system.

Temperature monitoring means may be provided downstream of the boiler to measure the temperature of the steam output of the boiler.

The temperature monitoring means may be connected to a control unit of the system which causes one of the said lines to open at a first temperature of superheated steam.

The control unit may be further connected to open a further one of the said lines when the temperature indicated by the temperature monitoring exceeds a second temperature of superheated steam which is higher than the said first temperature of superheated steam.

The control unit may thereby maintain a given flow rate or a given head of steam output.

The control unit may be such as to close a given one of the said lines at a predetermined temperature below that at which it opens that line, to provide a hysteresis range between the closing and opening temperatures.

The said first temperature of super heated steam may be substantially 5° Centigrade above boiling point of water at the pressure of the steam provided by the system. The said second temperature of superheated steam may be substantially 10° Centigrade above that boiling point.

The hysteresis range may be substantially 1° Centigrade.

The present invention extends to a method of raising steam by a system in accordance with the present invention.

An example of a steam-raising system in accordance with the present invention will now be described with reference to the accompanying drawings, in which.

Figure 1:
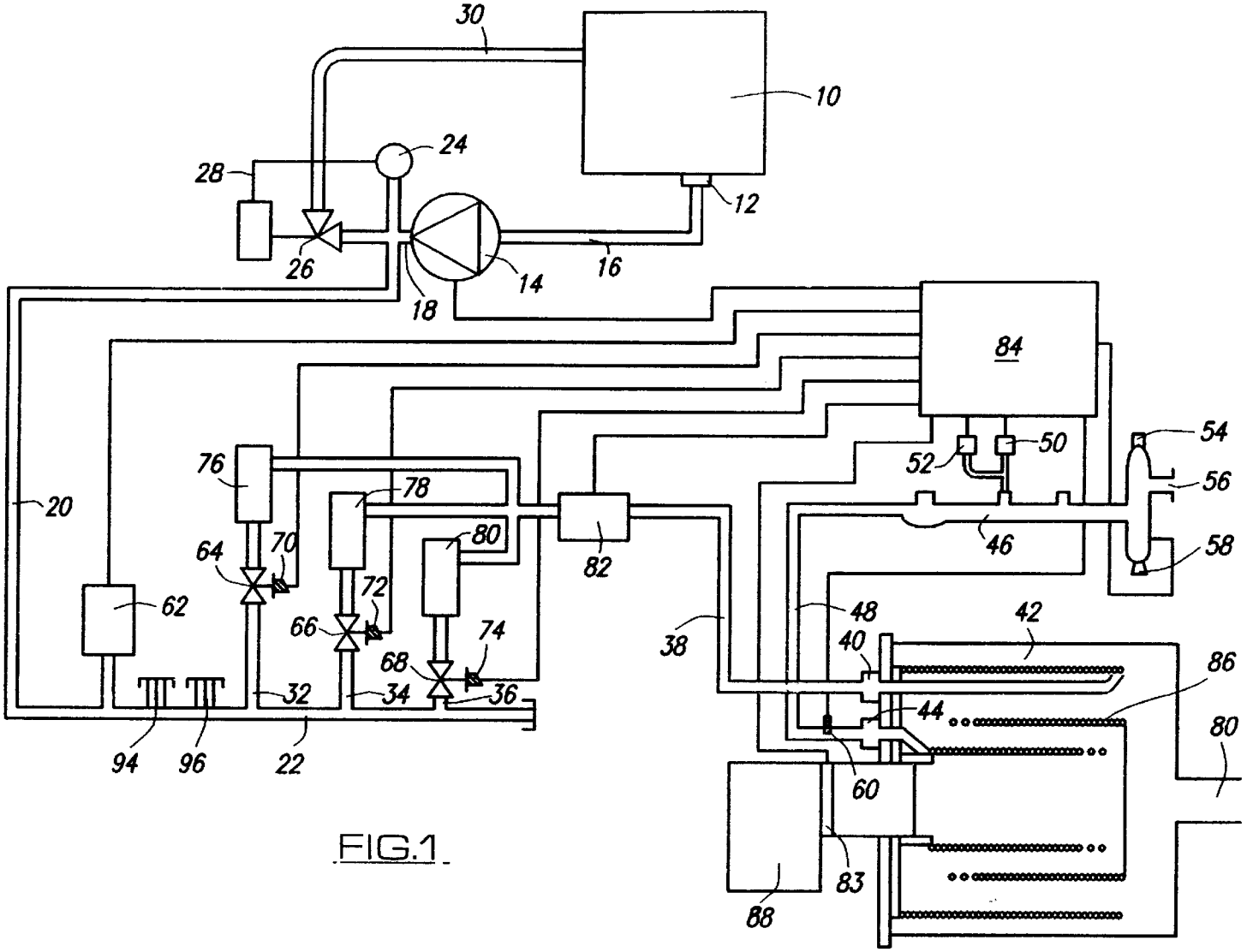
FIG. 1 shows a circuit diagram of the system.

The system shown in FIG. 1 comprises a boiler feed tank 10 having an outlet 12 which is connected to the input of a pump 14 via a passageway 16. The output 18 from the pump 14 is connected via a further passageway 20 to a gallery 22.

Also connected to the output 18 of the pump 14 is a pump discharge pressure gauge 24 and a manually adjustable valve 26. The valve 26 is such as to maintain the discharge pressure of the pump at a substantially constant preset value. This value is normally 28 Bar as read from the gauge 24. The valve 26 maintains this value by returning water to the boiler feed tank 10 via the return passageway 30, as necessary.

Three flow lines 32, 34, and 36 extend from the gallery 22 to a common feed passageway 38 for the delivery of water from the pump feed tank 10 via the passageway 16 and 20 and the gallery 22, to a water inlet 40 of a boiler 42. A steam outlet 44 from the boiler 42 is connected to a header 46 via a steam passageway 48. The header 46 is hollow and is generally T-shaped with the T on its side so that the part of the header corresponding to what is normally upright in the letter T is horizontal. The passageway 48 is connected at its end further from the steam outlet 44 to the base of the T of the header 46. Two pressure switches 50 and 52 are connected to the header 46 so as to be exposed to the pressure therewithin. The header 40 is also provided with a pressure safety valve 54 above the main steam outlet 56 of the header 46, and a header drain valve 58. A temperature sensor 60 is also provided on the passageway 48 as monitoring means to provide a measurement of the temperature of the steam from the boiler 42.

Within each flow line 32, 34, and 36 there are arranged respective solenoid-operated shut-off valves 64, 66 and 68 operated by solenoids 70, 72 and 74. Respectively connected in series with the shut-off valves 64, 66, and 68 are flow regulators 76, 78 and 80. The flow lines 32, 34, and 36 are all connected downstream of the flow regulators 76, 78 and 80 to a common flowmeter 82 from the output of which extends the passageway 38.

A further pressure safety cut-out switch 62 is connected to the gallery 22 so as to be exposed to the pressure thereof.

Outputs from the switches 50, 52 and 62 along with the output from the temperature sensor 60 are all electrically connected to respective inputs of a control unit 84. Outputs therefrom are respectively connected to the solenoids 70, 72, and 74.

The control unit 84 also has an output connected to the flowmeter 82, and a burner shut-off 83. If the flowrate of water is measured by the flowmeter 82 falls below a predetermined limit, for example 1 liter/min, the control unit will shut off the burner 83.

The boiler 42 comprises a multi-helical tubular conduit 86 which meanders within the interior of the boiler 42. The burner 88 of the boiler 42 directs a flame within the helices of the tubular conduit 86 to heat up the water and/or steam therewithin. The boiler 42 is also provided with a flue 90 for the escape of the combustion gases from the burner 88.

Figure 2:
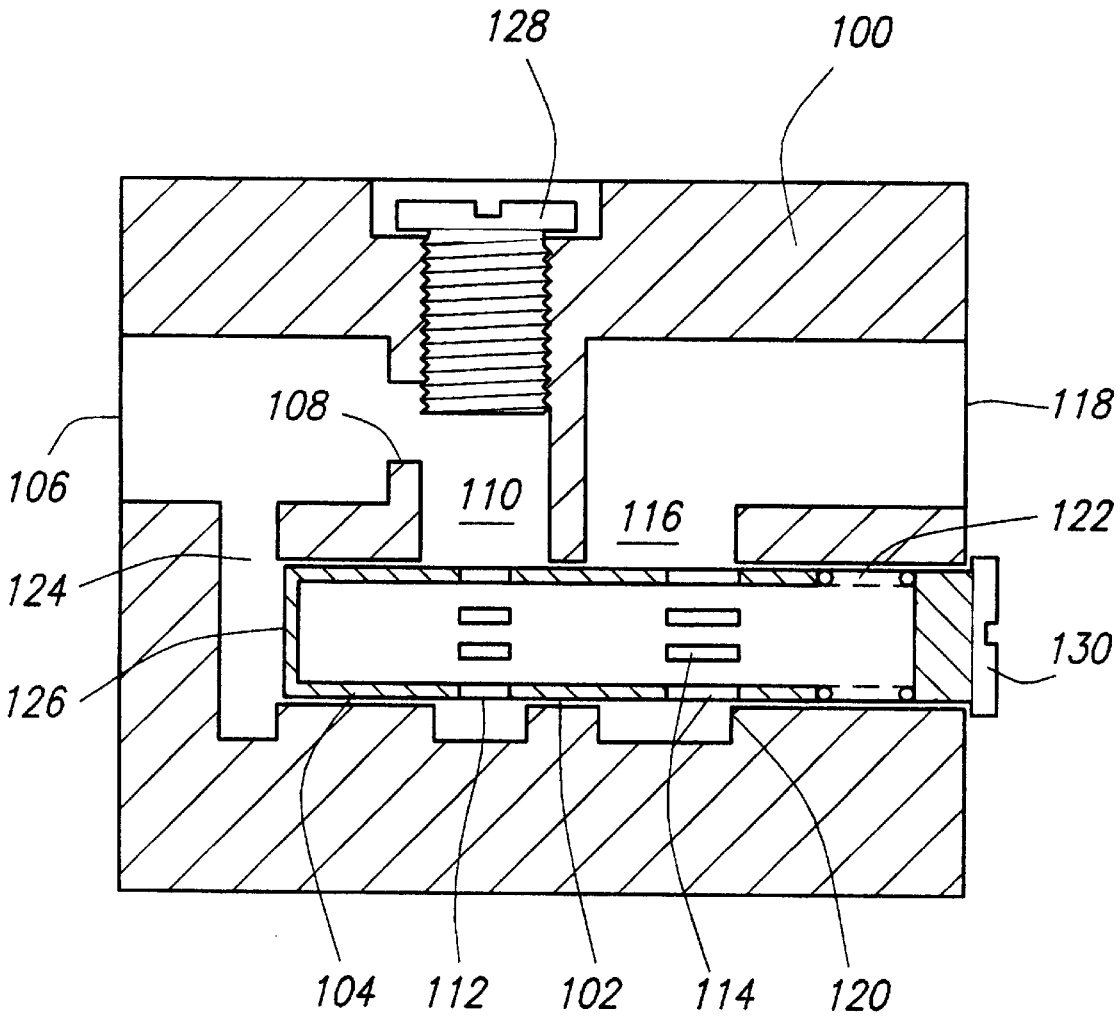
FIG. 2 shows an axial-sectional view through a flow regulator of the system shown in FIG. 1.

Whilst many constructions are possible for each of the flow regulators 76, 78 and 80, FIG. 2 shows one possible construction. It comprises a piston valve block 100 formed with a cylinder 102 within which a hollow piston 104 is slidable axially. An inlet 106 into the regulator extends axially and inwardly therein, to an orifice 108 between the inlet 106 and a transversely extending bore 110 which opens into the cylinder 102. The piston 104 is provided with slots 112, which put the piston interior into communication with the bore 110. The piston 104 is also provided with further slots 114 downstream of the slots 112, and these put the piston interior into communication with a further transverse bore 116 connected to an axially extending outlet 118. The slots 114 are adjacent to a shoulder 120 of the block 100. Movement of the piston 104 in a downstream direction causes the shoulder 120 to cut off increasing proportions of the slots 114, so as to reduce the area of those slots which is available for fluid to pass from the piston interior to the bore 116. Such movement of the piston 104 is resisted by a spring 122 within the block 100.

A further transverse bore 124 is provided by which the inlet 106 is in direct communication with a blind end 126 of the piston 104 further from the spring 122. The effective size of the orifice 108 is adjustable by means of a screw 128 which engages a screwthreaded portion of the block 100 where it defines the bore 110. The force exerted by the spring 122 on the piston 104 can be adjusted by means of a screw 130 which engages a screwthreaded portion of the block 100 where it defines an outer end of the cylinder 102.

When the system is in operation, the pump 14 feeds water from the boiler feed tank 10 to the boiler 42 via the passageways 16 and 20, the gallery 22, the lines 32 and/or 34 and/or 36, and the passageway 38. With the burner 88 switched on, the boiler 42 heats the water which passes through a helical conduit 86 so that the water becomes superheated steam by the time it exits the outlet 44 from the boiler 42. This superheated steam is then available at the outlet 56 from the header 46 to which the steam is fed from the boiler 42 via the passageway 48.

Initially, the control unit 84 opens only the solenoid-operated shut-off valve 64 so that water is fed at a constant rate through the flow regulator 76 to the passageway 38 and thence to the inlet 40 of the boiler 42. The flow regulator 76 maintains a constant flow at a rate which, for the given specification of the burner 88, produces superheated steam at the outlet 44 and consequently in the passageway 48 and at the header 46.

Once the temperature as indicated by the temperature sensor 60 exceeds the boiling point of water at the pressure set by the pressure switch 50 by more than 5° Centigrade, the control unit 84 switches open the solenoid-operated shut-off valve 66 to enable an additional amount of water to be fed to the boiler 42 via the flowmeter 82 and the passageway 38 at a rate determined by the flow regulator 78. In the relatively unlikely event that the temperature of the steam exceeds the boiling point of water for the pressure determined by the pressure switch 50 by more than 10° Centigrade, the control unit 84 opens the solenoid operated shut-off valve 68 to cause a further amount of water to flow into the passageway 38 via the flowmeter 82, at a flow rate determined by the flow regulator 80.

In the event that the temperature of the superheated steam at the temperature sensor 60 falls more than 1° Centigrade below the opening threshold temperature for the shut-off valve 66 or 68, the shut-off valves are closed by the control unit 84.

Such control enables superheated steam to be provided by the boiler at a given temperature, with a substantially constant pressure.

In the event that the pressure exceeds the predetermined pressure as set by the pressure switch 50, by a predetermined amount, the control unit 84 switches off the burner 88 at the switch 83. It also switches off the pump 14 and closes the shut-off valves 64, 66 and 68. Once the pressure indicated by the pressure switch 50 falls below the predetermined amount, the system is switched back on by the turning on of the pump 14, the opening of the valve 64, and the switching on of the burner 88 at the burner switch 83. There may be a hysteresis range between the pressure at which shut-down occurs and the pressure at which the system is switched back on.

In the event that either of the pressure switches 52, or 62 indicate a pressure which exceeds a predetermined value, the control unit 84 will also shut the system down as a safety measure by switching off the pump 14 and the burner 88 and also by closing the valves 64, 66 and 68.

Also in the event that the temperature sensor 60 indicates a temperature which exceeds a predetermined value, the control unit 84 will shut the system down as a safety measure.

It will be seen from the illustrated construction and of the flow regulator in FIG. 2 from the description given herein, that water enters the inlet 106 and flows from there through the bore 110 and then the slots 112 into the piston interior, and thence to the bore 116 via the slots 114 to the outlet 118. The force tending to urge the piston against the bias provided by the spring 130 comprises the fluid pressure in the bore 124. The forces urging the piston away from the spring 130 comprise the fluid pressure in the piston interior and also the force exerted by the spring 122. The differential pressure across the piston is therefore substantially equal to the force exerted by the spring 122. It will be appreciated that this force may be adjusted by means of the screw 130.

There is therefore a substantially constant pressure drop across the orifice 108 as a result of which there is a substantially constant flow of fluid through the regulator, and hence through both its inlet 106 and its outlet 118 substantially independently of the actual fluid pressure at those points. In the event that the pressure applied to the inlet 106 increases, the piston 104 consequently is urged by the momentarily increased pressure in the bore 124 against the spring 122. This reduces the effective area of the slots 114 available for fluid to flow into the bore 116. An equilibrium position is therefore found at which the pressure differential across the inlet 106 and the outlet 118 is again substantially the value determined by the force of the spring 122 acting on the piston 104. Since this is substantially constant, the pressure differential across the inlet 106 and the outlet 118 is maintained at a substantially constant value, and hence the flow through the orifice 108 is maintained substantially constant.

Numerous variations and modifications to the illustrated system will readily occur to a reader of ordinary skill in the art without taking the resulting modification or variation outside the scope of the present invention. To give one example only, in the event that the pump 14 is of such a construction as to provide a substantially constant pressure output, the flow regulators 76, 78 and 80 could each be replaced by a simple orifice plate provided the total flow capacity of the passageway 38 is not lower than the flow capacity of all three orifice plates for the given pressure provided by the pump 14.

The flow regulators 76, 78 and 80 may each comprise a Kates® Mini-Flo™ or a Kates® Fix-a-Flo™ regulator made by W.A. Kates® Company of 1450 Jarvis Avenue, Ferndale, Mich. 48220, United States of America and distributed in the United Kingdom by Fluid Controls Limited of Minerva House, Calleva Park, Aldermaston, Berkshire, RG7 4QW, England.

Two further sets 94 and 96 of three lines each for two further boilers may extend from the gallery 22, these lines being blanked off in the system illustrated in FIG. 1.

The temperature sensor 60 may comprise two temperature sensors, one for regulation and one for safety shutdown.

I claim:

1. A steam-raising system comprising a boiler having (a) a passageway for water and/or steam, (b) an inlet to the passageway through which water is introduced continuously for given periods when the boiler is in use, (c) a heater to heat the passageway, and (d) an outlet from the passageway from which steam emerges continuously as water is introduced through the inlet, the system further comprising a pump connected by a flow-path to the said inlet to pump water thereto along the said flow-path and flow control means in the said flow-path, wherein the flow control means comprise a plurality of lines which constitute a part of the flow-path, which are connected between the pump and boiler in parallel with one another, and which are independently openable to enable the amount of water delivered to the boiler to be varied, each of the said lines comprises a shut-off valve and a flow regulator which maintains a constant flow through the line substantially independently of the pressures upstream of its inlet and downstream of its outlet, temperature monitoring means are provided downstream of the boiler to monitor the temperature of the steam output of the boiler, control means are connected to the temperature monitoring means and the shut-off valves to control operation of those valves in dependence upon an output from the temperature monitoring means, and the control means are such as to close each of the said lines at a predetermined temperature below that at which it opens that line, to provide a hysteresis range between the closing and opening temperatures.

2. A steam-raising system according to claim 1, in which the shut-off valve is a solenoid-operated valve.

3. A steam-raising system according to claim 1, in which the flow regulator comprises a piston valve, the inlet part of which has a variable opening which is dependent upon the relative position of the piston in the valve.

4. A steam-raising system according to claim 3, in which the flow through the regulator is through a fixed orifice across which a fixed pressure differential is maintained by means of the piston-valve.

5. A steam-raising system according to claim 4, in which the fixed pressure differential is maintained by means of the piston-valve also by resilient means acting on the piston, the force of which determines the pressure differential across the orifice.

6. A steam-raising system according to claim 1, in which a first one of the lines and also the construction of the boiler is such that the flow rate allowed through that one of the lines when it is in the open condition, with the other lines in the closed condition, produces superheated steam at a given temperature in excess of the normal boiling temperature of water at the steam output pressure of the system.

7. A steam-raising system according to claim 1, in which the control means of the system causes one of the said lines to open at a first temperature of superheated steam.

8. A steam-raising system according to claim 7, in which the control means is further connected to open a further one of the said lines when the temperature indicated by the temperature monitoring means exceeds a second temperature of superheated steam which is higher than the said first temperature of superheated steam, whereby the control means may maintain a given flow rate or a given head of steam output.

9. A steam-raising system according to claim 8, in which the said first temperature of superheated steam is substantially 5° Centigrade above the boiling point of water at the pressure of the steam provided by the system.

10. A steam-raising system according to claim 8, in which the said second temperature of superheated steam is substantially 10° Centigrade above the boiling point of water at the pressure of the steam provided by the system.

11. A steam-raising system according to claim 1, in which the hysteresis range is substantially 1° Centigrade.

12. A method of raising steam comprising using the system as claimed in any one of claims 1 through 11.

* * * * *